US010533562B2

(12) United States Patent
Vaiyakkannu

(10) Patent No.: US 10,533,562 B2
(45) Date of Patent: Jan. 14, 2020

(54) PUMP SELECTION USING DYNAMIC PRIORITY NUMBERS

(71) Applicant: HONEYWELL INTERNATIONAL INC., Morris Plains, NJ (US)

(72) Inventor: Kumaran Vaiyakkannu, Tamil Nadu (IN)

(73) Assignee: Honeywell International Inc., Morris Plains, NJ (US)

( * ) Notice: Subject to any disclaimer, the term of this patent is extended or adjusted under 35 U.S.C. 154(b) by 348 days.

(21) Appl. No.: 15/477,896

(22) Filed: Apr. 3, 2017

(65) Prior Publication Data

US 2018/0283390 A1 Oct. 4, 2018

(51) Int. Cl.

| | |
|---|---|
| ***F04D 27/00*** | (2006.01) |
| ***F04D 15/02*** | (2006.01) |
| ***F04B 49/02*** | (2006.01) |
| ***F04B 41/06*** | (2006.01) |
| *F04B 49/06* | (2006.01) |

(52) U.S. Cl.

CPC ..... *F04D 27/00* (2013.01); *F04B 41/06* (2013.01); *F04B 49/02* (2013.01); *F04D 15/029* (2013.01); *F04D 15/0245* (2013.01); *F04D 15/0254* (2013.01); *F04B 49/06* (2013.01)

(58) Field of Classification Search

CPC .... F04D 15/0245; F04D 15/029; F04D 27/00; F04D 15/0254; F04B 2203/0214; F04B 41/06; F04B 49/02; F04B 49/06

See application file for complete search history.

(56) References Cited

U.S. PATENT DOCUMENTS

| | | | | |
|---|---|---|---|---|
| 3,453,962 | A | 7/1969 | Strader | |
| 3,744,932 | A | 7/1973 | Prevett | |
| 4,805,118 | A * | 2/1989 | Rishel | G01L 3/26 340/606 |
| 5,742,500 | A * | 4/1998 | Irvin | F04D 15/0066 417/2 |
| 6,250,894 | B1 | 6/2001 | Dyer et al. | |
| 7,010,393 | B2 * | 3/2006 | Mirsky | F04D 15/0022 417/1 |
| 7,143,016 | B1 | 11/2006 | Discenzo et al. | |
| 7,195,462 | B2 * | 3/2007 | Nybo | F04D 15/029 417/53 |

(Continued)

OTHER PUBLICATIONS

Anthony E. Stavale, et al., "Development of a Smart Pumping System", Proceedings of the 18th International Pump Users Symposium, Houston, TX, Mar. 5-8, 2001, pp. 67-76.

*Primary Examiner* — Dominick L Plakkoottam

(57) ABSTRACT

A control system includes a processor with pump data for a parallel connected plurality of pumps in a database of an associated memory for implementing a dynamic priority number (DPN)-based pump selection algorithm for a method of pump selection for the plurality of pumps. The method includes calculating a DPN using pump data regarding a plurality of pump parameters for each of the plurality of pumps. The DPNs are dynamically updated when at least one of the pump parameters changes. The DPNs are used together with a current pump demand to dynamically select which of the pumps are to be turned on or off, and the dynamic selection is implemented. The DPNs can be calculated using a DPN equation.

14 Claims, 6 Drawing Sheets

(56) References Cited

U.S. PATENT DOCUMENTS

| | | | | |
|---|---|---|---|---|
| 8,328,523 | B2 * | 12/2012 | Kernan | G05B 13/0205 417/5 |
| 2009/0020173 | A1 * | 1/2009 | Lau | F04D 15/029 137/565.01 |
| 2014/0180485 | A1 * | 6/2014 | Stavale | F04D 15/0066 700/282 |
| 2015/0252814 | A1 * | 9/2015 | Nakahara | F04D 15/0088 700/282 |

* cited by examiner

| PUMP DATA | ENERGY MANAGEMENT FACTOR (PEM) | FLOW CAPACITY (PC) | STATE (PS) | MODE (PM) | IDLE TIME (PIT) | TOTAL RUN TIME (TRT) | AGE (PA) | MAINTENANCE HISTORY (LMH) | DPN |
|---|---|---|---|---|---|---|---|---|---|
| PUMP 1 | 2 | 2000 | 1 | 1 | 2 | 62 | 0.25 | 1 | 516 |
| PUMP 2 | 1.5 | 1500 | 1 | 1 | 50 | 89 | 5 | 1 | 253 |
| PUMP 3 | 1.5 | 1000 | 1 | 1 | 40.5 | 462 | 2.1 | 2 | 31 |
| PUMP 4 | 2.1 | 1500 | 1 | 1 | 6 | 42 | 0.5 | 1 | 900 |
| PUMP 5 | 1 | 1000 | 1 | 1 | 7 | 74 | 0.9 | 1 | 105 |
| PUMP 6 | 3 | 2500 | 1 | 1 | 0.5 | 5 | 4 | 5 | 38 |
| PUMP 7 | 2 | 1000 | 1 | 1 | 9 | 46 | 5.2 | 4 | 19 |
| PUMP 8 | 1.5 | 750 | 1 | 1 | 3.2 | 81 | 1.8 | 2 | 12 |
| PUMP 9 | 2.5 | 1500 | 1 | 1 | 5 | 20.6 | 6.5 | 1 | 140 |
| PUMP 10 | 2 | 1500 | 1 | 1 | 4.2 | 8.6 | 4.5 | 6 | 54 |

FIG. 5

PUMP SELECTION USING DYNAMIC PRIORITY NUMBERS

FIELD

Disclosed embodiments relate to pump load sharing for parallel connected pumps.

BACKGROUND

Some industrial facilities operate a plurality of pumps in parallel. For example, in refining industries, tank to tank, tank to ship, and pipeline movement transfer all involve a plurality of pumps in parallel which requires some pump load share management to determine which pumps are to be running at any given time. As known in the art, pump selection is performed by grouping with respect to pump capacity and the flow demand supported.

SUMMARY

This Summary is provided to introduce a brief selection of disclosed concepts in a simplified form that are further described below in the Detailed Description including the drawings provided. This Summary is not intended to limit the claimed subject matter's scope.

Disclosed embodiments recognize there is a large amount of pump data generally available at the process controller (e.g., Distributed Control System (DCS) or a Programmable Logic Controller (PLC)). However, known pump management systems use direct sequential pump control methods which only utilize a minimal of pump data (e.g., only pump flow capacity (PC)) for selecting the pumps to be on or off responsive to a flow demand, and thus always operate over time using the same pump sequence resulting the need for more pump maintenance of pumps and more pump downtime.

Disclosed dynamic pump selection uses a new form of pump selection which selects the pumps and balances the usage of the pumps by using a dynamic priority number (DPN) for each pump which is dynamically calculated from the PC as well as operational data regarding a plurality of other pump parameters. The DPNs are calculated for each pump with currently available pump data, and the DPNs are dynamically calculated when the pump data is changed or updated. Flow is the parameter for pump demand when the flow demand is getting changed, and the respective pumps will be started or stopped based on DPN values to balance the flow demand. Disclosed dynamic pump selection has been found to improve the pump efficiency and reduce the maintenance cost, thus improving site efficiency (see the Examples section described below).

One disclosed embodiment comprises a method of pump selection for a parallel connected plurality pumps. A DPN is calculated using pump data regarding a plurality of pump parameters for each of the pumps. The DPNs are dynamically updated when at least one of the pump parameters changes. The DPNs are used together with a current pump demand to dynamically select which pumps are to be turned on or off, and the pumps are commanded to implement the dynamic selections.

BRIEF DESCRIPTION OF THE DRAWINGS

FIG. 5 is table showing pump parameters for pumps shown as pumps 1 to 10 and their resulting current DPN values, according to an example embodiment.

DETAILED DESCRIPTION

Figure 1A:
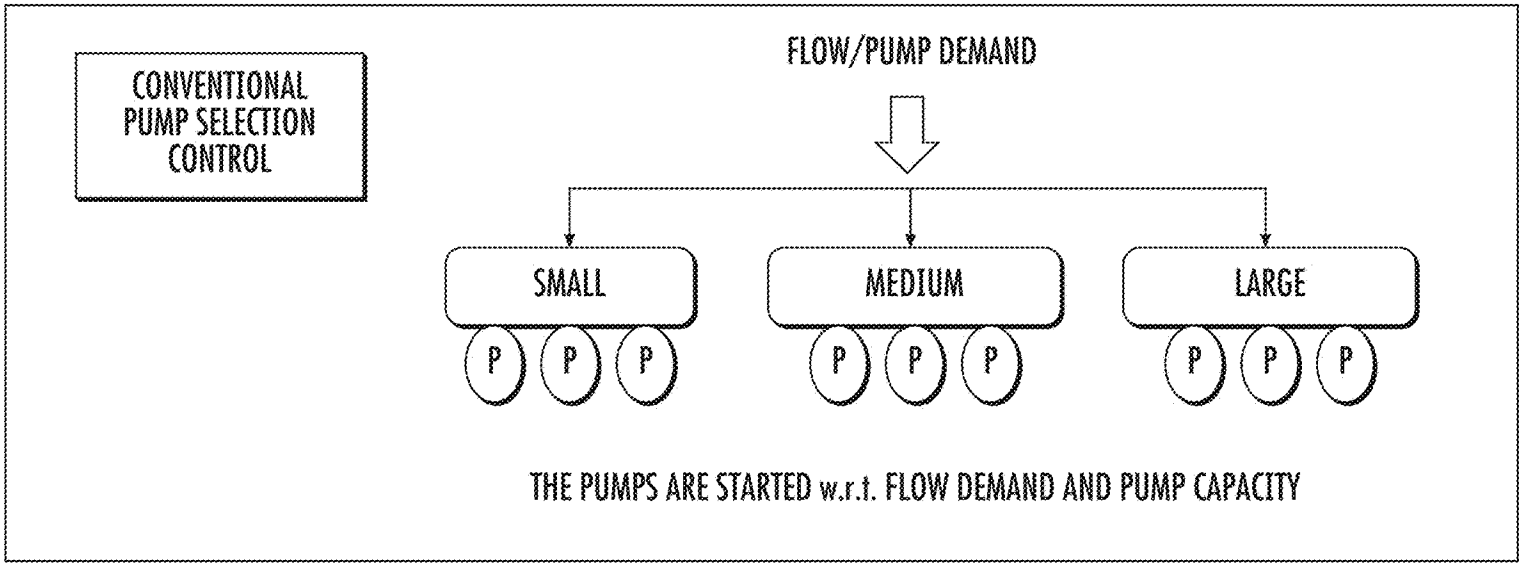
FIG. 1A (PRIOR ART)
FIG. 1A is a conceptual flow diagram for a known direct sequential pump control method for selecting respective ones of parallel connected pumps.

Disclosed embodiments are described with reference to the attached figures, wherein like reference numerals are used throughout the figures to designate similar or equivalent elements. The figures are not drawn to scale and they are provided merely to illustrate certain disclosed aspects. Several disclosed aspects are described below with reference to example applications for illustration. It should be understood that numerous specific details, relationships, and methods are set forth to provide a full understanding of the disclosed embodiments.

One having ordinary skill in the relevant art, however, will readily recognize that the subject matter disclosed herein can be practiced without one or more of the specific details or with other methods. In other instances, well-known structures or operations are not shown in detail to avoid obscuring certain aspects. This Disclosure is not limited by the illustrated ordering of acts or events, as some acts may occur in different orders and/or concurrently with other acts or events. Furthermore, not all illustrated acts or events are required to implement a methodology in accordance with the embodiments disclosed herein.

Disclosed DPN-based pump selection control utilizes known current flow demand, but adds pump operational data as additional data inputs in generating DPN values. Pump groups are optionally used with disclosed embodiments which are generally grouped as small, medium and large pump groups with respect to the pump's flow and pumping capacity. (See FIGS. 1A and 1B described below). Flow demand is the required flow, such as with respect to the number of transfer or shipments started. Transfer and shipment are types of internal or customer orders used to transfer products from tank to tank, tank to truck, and tank to rail or to ship.

The pump operational data can comprise the following DPN parameters: Total run time (RT) is the total time the pump is used in the plant and it also includes maintenance runtime. Pump flow capacity-(PC) is the maximum flow rate support by pump for all the product used. The age of the pump (AP) is the total time from new pump installation. The last maintenance history (MH) is the number of times the pump is taken for maintenance. The last run state (IRS) is used to find pumps used in last transfer, shipment sequence. The pump idle time (PIT) is used to find the total non-run time of the pump from last run.

Optional DPN parameters include pump mode (service/out of service)-(PM) which is the current pump state. Pump state (auto/manual)-(PS) is the state used to control from remote pump logic or manual operation. The PM and PS can be set as constant values.

FIG. 1A is a conceptual flow diagram for a known sequential pump control method for selecting respective ones of parallel connected pumps, shown as a small pump group, medium pump group and large pump group, with 3 pumps shown in each group only as an example. The pumps are started with respect to flow demand and pump capacity. When the initial flow demand starts any one of the small pumps is started and for subsequent flow demand pumps in the medium and large pump groups are then started.

Figure 1B:
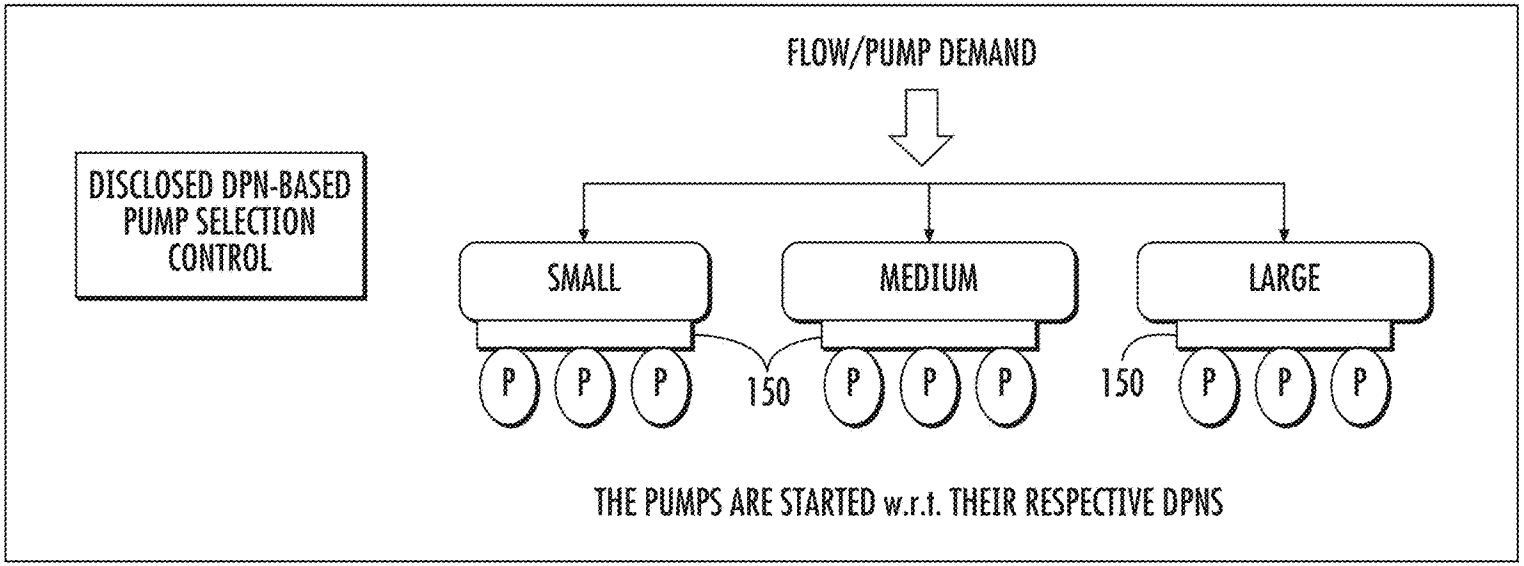
FIG. 1B is a conceptual flow diagram for a disclosed DPN-based pump selection control for selecting respective ones of parallel connected pumps according to an example embodiment.

FIG. 1B is a conceptual flow diagram for disclosed DPN-based pump selection control for selecting respective parallel connected pumps according to an example embodiment. The pumps for DPN-based pump selection control are started by control provided by a DPN-based pump selection algorithm 150 that utilizes current DPN values for each of the pumps. The DPN-based pump selection algorithm can be implemented in hardware including digital logic or implemented by software in a memory run by a processor. By disclosed integrating pump selection with DPN the pumps are started first with relatively high DPN numbers and stopped first with relatively low DPN with respect to flow demand, which ensures less frequent usage of same pumps by more effectively determining the pump selection.

Figure 2:
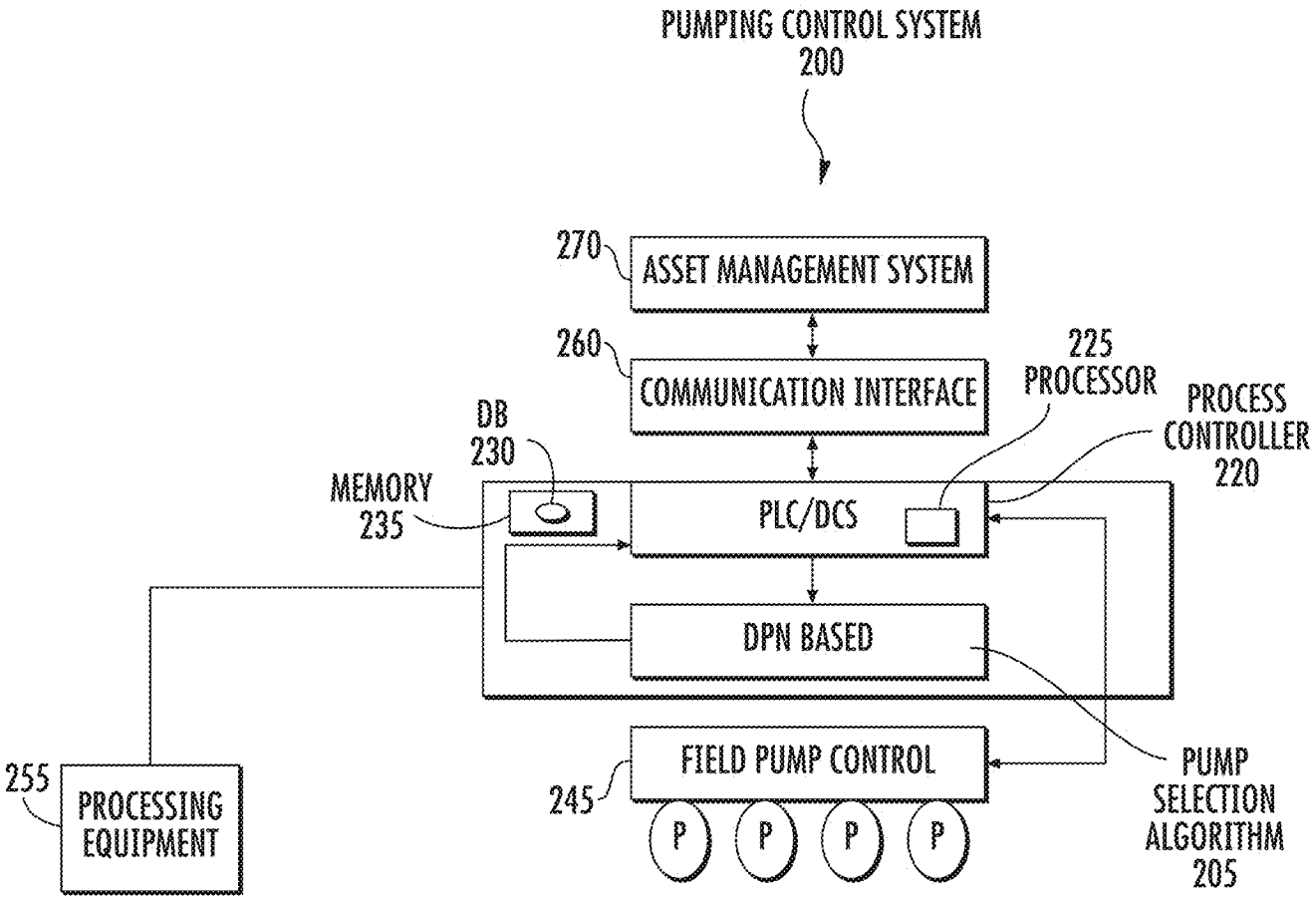
FIG. 2 is an example control system showing pump control based on disclosed DPN-based pump selection control implemented in a process controller that is coupled to control the pumps, according to an example embodiment.

FIG. 2 is an example pumping control system 200 showing pump control based on disclosed DPN-based pump selection control implemented in a process controller 220 that is coupled to field pump control 245 (e.g., actuators or switches with pump selection logic) which control the pumps (shown as Ps), according to an example embodiment. The process controller 220 can comprise a Programmable Logic Controller (PLC) or distributed control system (DCS) having a processor 225 with pump data in a database (DB) 230 of an associated memory 235 implementing a DPN-based pump selection algorithm 205. The process controller 220 sends control signals to field pump control 245 that has pump selection logic for controlling the turning on or off of each of the plurality of parallel connected pumps P. The process controller 220 also controls other aspects of the process being run shown being coupled to processing equipment 255.

Pumping control system 200 is shown having a communication interface 260 that couples the process controller 220 to an asset management system 270. The communication interface 260 can be used to transfer the pump data from the asset management system 270 to the process controller 220 if DB 230 is not provided. Communication interface 260 can comprise Ethernet such as Fault Tolerant Ethernet (FTE), Modbus, Fieldbus, and the asset management system 270 can comprise control system and field assets.

In this embodiment in FIG. 2 the pump data in the DB 230 can be collected from the asset management system 270 or from the process controller 220 (e.g., PLC/ DCS system) and the DPN-based pump selection algorithm 205 although shown installed on the process controller 220 (e.g., on a DCS server) can also be installed on the asset management system 270 which generally has most of the site field device operation and maintenance data. Asset management system 270 can comprise in one specific fuel facility embodiment a blending and movement application server. Once the DPN-based pump selection algorithm 205 is configured with the pump data, it calculates the DPNs so that when pump demand is requested the DPN-based pump selection algorithm 205 shown integrated with the process controller 220 in level 2 uses the pump data from the communication interface 260 to calculate the DPN for each pump and provide the DPNs to the field pump control 245 which can includes pump selection logic for pump selection.

Figure 3:
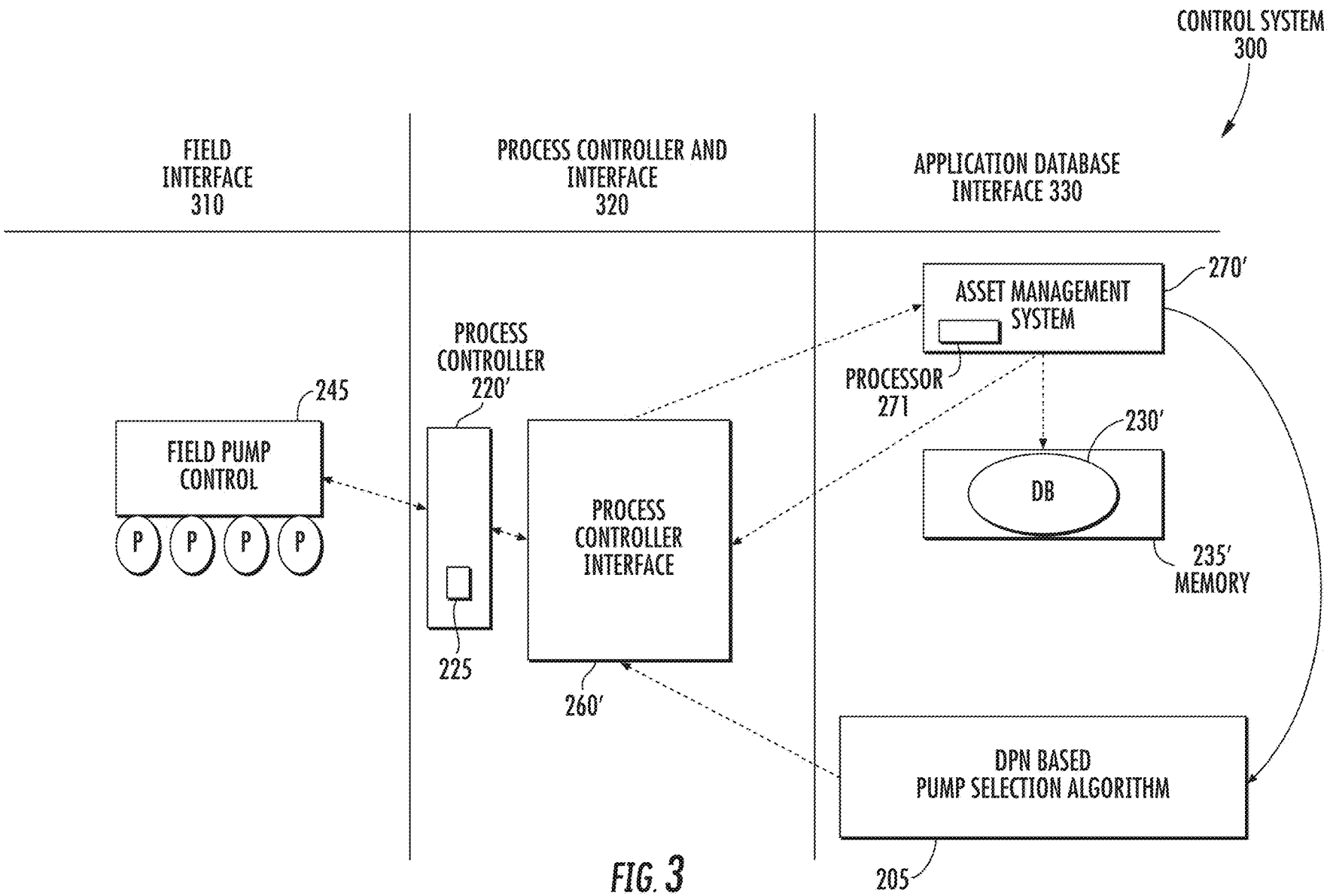
FIG. 3 is an example control system showing an asset management system having a processor with the pump data in a database of an associated memory implementing a DPN-based pump selection algorithm, where the DPN-based pump selection algorithm is coupled to control the pumps, according to an example embodiment.

FIG. 3 is an example control system 300 showing an asset management system 270' having a processor 271 with the pump data in a DB 230' of an associated memory 235' implementing a DPN-based pump selection algorithm 205, according to an example embodiment. Control system 300 is shown having 3 interfaces, a field interface 310, a process controller and interface 320 and an application database interface 330. The DPN-based pump selection algorithm 205 is shown coupled by a process controller interface 260' to a process controller 220'. The process controller 220' is used to execute logic to control the field pump control 245 which includes pump selection logic for pump selection to control the turning on or off of the pumps.

Figure 4:
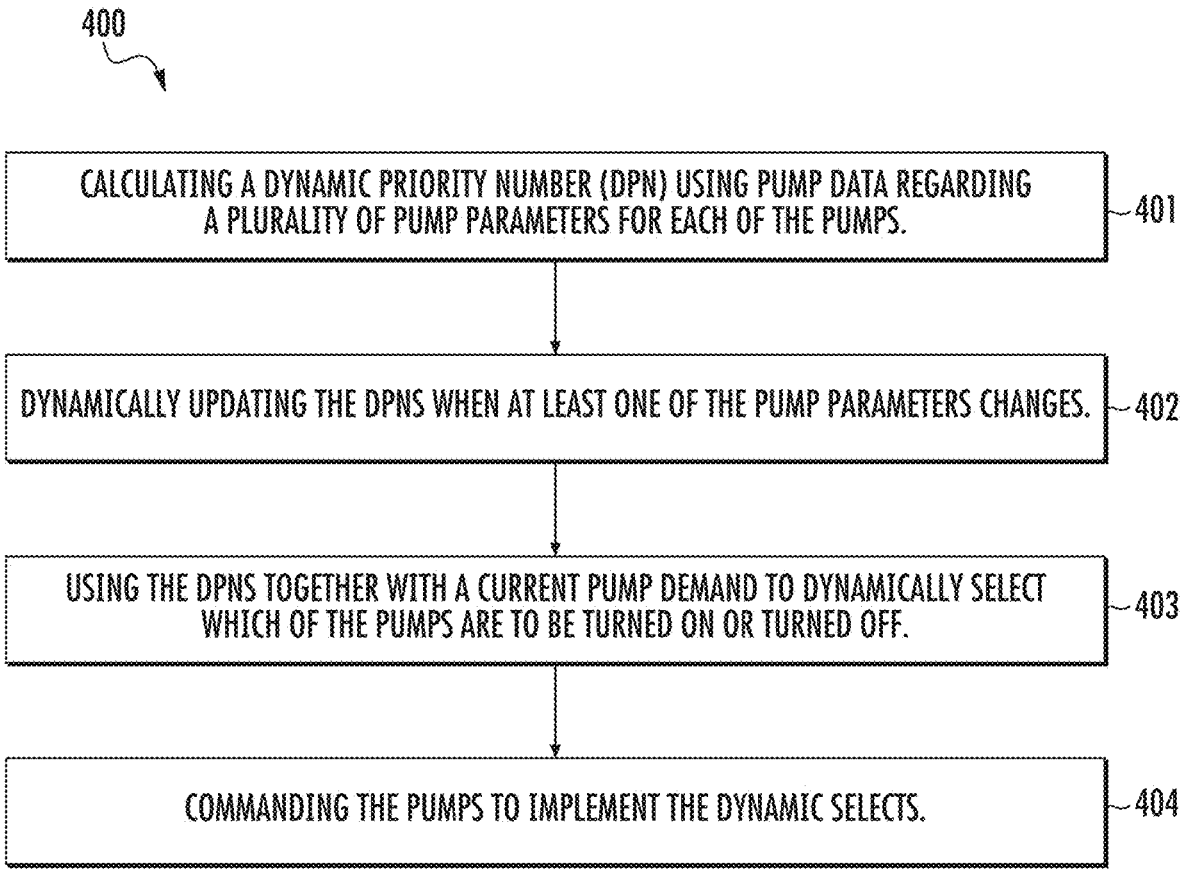
FIG. 4 is a flow chart that shows steps in a method of pump control method using DPNs for selecting respective ones of parallel connected pumps to be on or off, according to an example embodiment.

FIG. 4 is a flow chart that shows steps in a method 400 of pump selection for a parallel connected plurality of pumps, according to an example embodiment. Step 401 comprises calculating DPNs using pump data regarding a plurality of pump parameters for each of the pumps. Step 402 comprises the DPNs being dynamically updated when at least one of the pump parameters changes.

The calculating of the DPNs generally comprises using a DPN equation. For example, in one particular embodiment the DPN equation can comprise:

$$DPN=(PEM\times PC\times PS\times PM\times PIT)/(TRT\times AP\times LMH):$$

wherein PEM is a Pump Energy Management Factor, PC is a Pump Flow Capacity, PS is a Pump state, PM is a Pump Mode, PIT is a Pump Idle Time, TRT is a Total run Time, AP is an age of the Pump, and LMH is a Last Maintenance History. Although not shown, coefficients can be added to change the weights of the respective parameters in the DPN equation. Moreover, other parameters may be added. When at least one of the pump parameters changes, then the DPNs are typically dynamically updated in real-time.

Step 403 comprises using the DPNs together with a current pump demand to dynamically select which of the pumps are to be turned on or be turned off. The current pump demand can comprise flow demand or pressure demand. Step 404 comprises commanding the pumps to implement the dynamic selections in step 403, generally by sending control signals to an actuator at each pump.

The plurality of pumps can be in an industrial facility comprising a refinery tank farm, a storage tank farm, a terminal tank farm, or can be involved in pipeline transfers. As noted above the pump data can be obtained from a database in a memory associated with an asset management system that can be cloud-based. Refining industries, tank-to-tank, tank-to-ship, and pipeline movement transfer are all examples that involve pump control that can benefit from disclosed embodiments.

EXAMPLES

Disclosed embodiments are further illustrated by the following specific Examples, which should not be construed as limiting the scope or content of this Disclosure in any way.

In a plant that fills liquid petroleum product in multiple trucks from a storage tank, when the first truck filling starts assume the flow demand is 1500 $m^3$ then the pump with same or almost equal capacity pump will be started with DPN validation, so that the pumps selected and started will be those having the highest DPN number. Assume when subsequent truck filling starts the flow demand will increase from 1,500 $m^3$ to a required flow of 2,500 $m^3$ and accordingly the next pump will be started in sequence with respect to DPN validation (the pump with the next highest DPN number). When the truck filling has stopped and then flow demand decreases, the pumps will be stopped in sequence with the pumps currently on with the lower DPN values being turned off first.

A case study was performed. To demonstrate advantages of disclosed DPN-based pump selection it was considered the below data for 10 pumps and derived DPN values for each of the pumps. The following pump data was used to derive the DPNs with the DPN equation described above and shown again below.

$$DPN=(PEM\times PC\times PS\times PM\times PIT)/(TRT\times AP\times LMH)$$

Using current values for each of the above parameters and the DPN equation above DPN values were calculated for each pump shown as pump 1 to pump 10 in FIG. 5. It was assumed the pumps 1 to 10 are used in the one of the pumps groups in the site. Pump grouping is the logical segregation of pumps with respect to capacity so that responsive to an initial flow demand then the pumps in small capacity groups are operated first, then in the medium groups, and finally in large group.

For known pump selection the pumps are always started and stopped in same sequence so that the pump start/stop sequence is always constant from Pump 1 to Pump 10. At initial pump demand pump 1 is started and subsequent pump demand with respect to flow demand the pumps are started in same sequence.

In contrast, by using disclosed DPNs for pump control the pump start/stop sequence are controlled with currently calculated DPN numbers, and also the sequence of pump start/stop is not constant because it varies with actual pump data, which helps in improve pump usages, reduce the frequency of pump maintenance, and improves the plant efficacy. The pump parameters used to calculate the DPNs as described above can be obtained from any data interface, such as an asset management system, field inputs, database interface, or cloud data interface.

Figure 6:
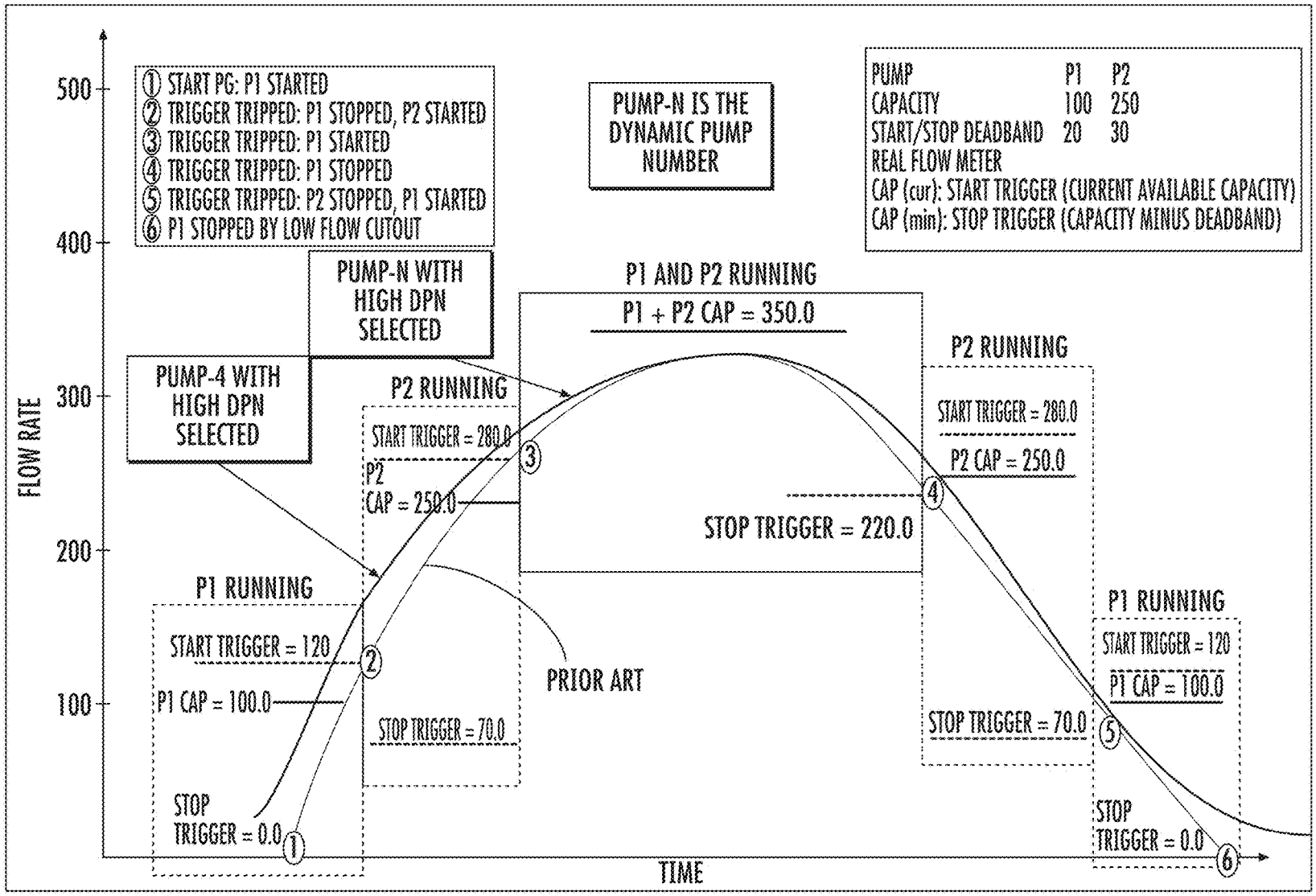
FIG. 6 shows a plot of flow rate vs. time showing pumps being turned on and off comparing known direct sequential pump control and pump selection using disclosed DPN-based pump selection control for selecting respective ones of parallel connected pumps to be on or off.

As shown by the highlight in in FIG. 5 pump 4 starts first despite having an intermediate PC (1500) based on its DPN value of 900 which is the highest of all the pumps in this example. FIG. 6 shows flow rate as a function of time for DPN-based pump selection and conventional pump selection based on only pump groups and current flow demand (marked "prior art). For disclosed DPN-based pump selection, dynamically based on flow demand and DPNs the stopped pumps are considered for DPN-based pump start sequence and running pumps are considered for the DPN-based pump stop sequence.

With reference now to FIG. 6, for known conventional sequential pump selection the pumps are controlled mostly in same sequence. For disclosed DPN-based pump selection in contrast pump 4 is shown started first and when next pump start demand is triggered by the flow demand the DPN is compared among only with stopped pumps (excluding the current running pumps, in this Example pump 4) and the next pump with a currently high DPN is started, where pump 1 is started next having the net highest DPN value. Similarly, when pump stop demand is triggered the DPN is compared among only with running pumps (excluding the current stopped pumps, pump 2, 3, 5, 6, 7, 8, 9 and 10) and the pump with currently a relatively low DPN is stopped first. As per this Example pump 1 will be stopped first and then pump 4.

Disclosed embodiments can be applied to generally to systems having a plurality of pumps connected in parallel which requires some pump load share management to determine which pumps to select to be running at any given time. For example, refining industries, tank to tank, tank to ship, and pipeline movement transfer.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. For example, although described for pumps may be applied to multi-evaporation group air conditioning systems, and other types of systems. In addition, while a particular feature may have been disclosed with respect to only one of several implementations, such feature may be combined with one or more other features of the other implementations as may be desired and advantageous for any given or particular application.

As will be appreciated by one skilled in the art, the subject matter disclosed herein may be embodied as a system, method or computer program product. Accordingly, this Disclosure can take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, this Disclosure may take the form of a computer program product embodied in any tangible medium of expression having computer usable program code embodied in the medium.

The invention claimed is:

1. A method of pump selection for a parallel connected plurality of pumps, comprising:

determining a dynamic priority number (DPN) using pump data regarding a plurality of pump parameters for each of said plurality of pumps including at least a pump flow capacity, a total run time, and an age measured from a time of installation;

wherein said DPNs are dynamically updated when at least one of said plurality of pump parameters changes;

using said DPNs based on a ranking of said DPNs together with a current pump demand to dynamically select which of said plurality of pumps are to be turned on or off, and commanding said plurality of pumps to implement said dynamic selects.

2. The method of claim 1, wherein said method is implemented by a process controller having a processor with said pump data in a database of an associated memory implementing a DPN-based pump selection algorithm, wherein said process controller is coupled to control said plurality of pumps.

3. The method of claim 1, wherein said method is implemented by an asset management system having an associated processor with said pump data in a database of an associated memory implementing a DPN-based pump selection algorithm, wherein said asset management system is coupled to a process controller that is coupled to control said plurality of pumps.

4. The method of claim 3 wherein said asset management system is cloud-based.

5. The method of claim 1, wherein said determining said DPNs comprises using a DPN equation.

6. The method of claim 1, wherein at least one of said pump parameters are dynamically updated in real-time.

7. The method of claim 1, wherein said plurality of pumps are in an industrial process facility comprising a tank farm or are involved in pipeline transfers.

8. A control system, comprising:

a processor with pump data for a parallel connected plurality of pumps in a database of an associated memory implementing a dynamic priority number (DPN)-based pump selection algorithm for a method of pump selection for said plurality of pumps, said method comprising:

determining a DPN using said pump data regarding a plurality of pump parameters for each of said plurality of pumps including at least a pump flow capacity, a total run time, and an age measured from a time of installation;

wherein said DPNs are dynamically updated when at least one of said plurality of pump parameters changes;

using said DPNs based on a ranking of said DPNs together with a current pump demand to dynamically select which of said plurality of pumps are to be turned on or off, and commanding said plurality of pumps to implement said dynamic selects.

9. The control system of claim 8, further comprising a process controller having said processor for implementing said method, wherein said process controller is coupled to control said plurality of pumps.

10. The control system of claim 8, further comprising an asset management system having said processor for implementing said method, wherein said asset management system is coupled to a process controller that is coupled to control said plurality of pumps.

11. The control system of claim 10, wherein said asset management system is cloud-based.

12. The control system of claim 8, wherein said determining said DPNs comprises using a DPN equation.

13. The control system of claim 8, wherein at least one of said DPNs are dynamically updated in real-time.

14. The control system of claim 8, wherein said plurality of pumps are in an industrial process facility comprising a tank farm or are involved in pipeline transfers.

* * * * *